US006659473B2

(12) United States Patent
Below et al.

(10) Patent No.: US 6,659,473 B2
(45) Date of Patent: Dec. 9, 2003

(54) CHUCK FOR A PERCUSSION HAND-HELD POWER TOOL

(75) Inventors: Armin Below, Kaufering (DE); Uto Plank, Freising (DE); Erwin Manschitz, Germering (DE); Josef Anzinger, Munich (DE); Harald Geiger, München (DE)

(73) Assignee: Hilti Aktiengesellschaft, Schaan (LI)

( * ) Notice: Subject to any disclaimer, the term of this patent is extended or adjusted under 35 U.S.C. 154(b) by 0 days.

(21) Appl. No.: 09/942,384

(22) Filed: Aug. 29, 2001

(65) Prior Publication Data

US 2003/0006566 A1 Jan. 9, 2003

(30) Foreign Application Priority Data

Sep. 4, 2000 (DE) ..... 100 43 416

(51) Int. Cl.[7] ..... B25D 17/08

(52) U.S. Cl. ..... 279/19.4; 279/74; 279/82

(58) Field of Search ..... 279/19, 19.4, 19.5, 279/24, 29, 74, 82, 904

(56) References Cited

U.S. PATENT DOCUMENTS

| | | | | |
|---|---|---|---|---|
| 5,505,570 A | * | 4/1996 | Meyen | 279/19.4 |
| 5,558,478 A | * | 9/1996 | Odendahl et al. | 279/19.5 |
| 6,135,461 A | * | 10/2000 | Below et al. | 279/19.4 |
| 6,179,300 B1 | * | 1/2001 | Baumann et al. | 279/19.4 |
| 6,261,035 B1 | * | 7/2001 | Moores, Jr. et al. | 408/239 R |
| 6,543,789 B2 | * | 4/2003 | Frenzel et al. | 279/74 |

* cited by examiner

*Primary Examiner*—Steven C. Bishop
(74) *Attorney, Agent, or Firm*—Sidley Austin Brown & Wood, LLP

(57) ABSTRACT

A chuck for a percussion hand-held power tool including a coupling sleeve (3) for receiving a working tool and having two diametrically opposite, slot-shaped, radial openings (4, 4') in which two locking members (5) radially and axially displace a locking sleeve 6 surrounding the coupling sleeve (3) and the locking members (5), and a spring-biased push-sleeve (8) formlockingly cooperating with the locking members (5), with the locking members (5) being supported against the inner surface (7) of the locking sleeve (6), extending into an interior of the coupling sleeve (3), and having each a radial dimension greater than a thickness of the coupling sleeve wall and a width decreasing toward a chuck axis (A).

5 Claims, 2 Drawing Sheets

CHUCK FOR A PERCUSSION HAND-HELD POWER TOOL

BACKGROUND OF THE INVENTION

1. Field of the Invention

The present invention relates to chuck for a percussion hand-held power tool, such as a hammer drill or a chisel hammer, for receiving a working tool, e.g., a trepan.

2. Description of the Prior Art

In percussion hand-held power tools, an anvil, which reciprocates along a working tool axis, applies blows to a working tool which is secured in the chuck for joint rotation therewith with driving webs provided in the chuck and engageable in receiving grooves of the working tool. The working tool is also secured for a limited axial displacement with locking members provided in the chuck engageable in the locking grooves of the working tool.

With conventional chucks, the locking of the working tool is effected with an actuation member. A drawback of the conventional chuck consists in that the impact or blow energy, which is not passed into a constructional component, i.e., so-called idle impact energy, becomes absorbed by the chuck and the working tool, which can result in the damage of the chuck and in inadvertent unlocking of the working tool.

German Publication DE 43 10 835 discloses a chuck with a receiving sleeve having two, diametrically opposite, slot-shaped openings, two locking members, which displace axially and radially in respective openings, have a substantially cuboid shape with additional, sidewise extending wings. The wings prevent a radial displacement of the locking members toward the axis. The locking members have receiving groove in which a stirrup engages, providing for a formlocking connection of the locking members with an axially displaceable push-sleeve. The stirrup adjoins the manually operated, spring-biased push-sleeve. The locking sleeve, which supports the locking members, abuts a damping member, whereby an idle impact or blow is damped. The drawback of the chuck of DE 43 10 835 consists in the use of a manually operated push-sleeve.

An object of the present invention is to provide a chuck for a percussion hand-held power tool with which any manual operation for locking the working tool is eliminated.

SUMMARY OF THE INVENTION

This and other objects of the present invention, which will become apparent hereinafter, are achieved by providing a chuck for a percussion hand-held power tool and including a coupling sleeve for receiving a working tool and having two diametrically opposite, slot-shaped, radial openings, two locking members radially and axially displaceable in respective radial openings, a locking sleeve surrounding the coupling sleeve and the locking members and having an inner surface radially expanding in a direction opposite to an operational direction of the working tool, i.e., a direction in which the working tool would face a worked component, and a spring-biased push-sleeve formlockingly cooperating with the locking members. The locking members are supported against the inner surface of the locking sleeve, extend into an interior of the coupling sleeve, and have each a radial dimension greater than a thickness of the coupling sleeve wall and a width decreasing toward the chuck axis.

The width of the radial openings of the coupling sleeve likewise decreases toward the chuck axis. As a result, radial displacement of the locking members toward the chuck axis is limited, and the locking members cannot fall through the radial openings of the coupling sleeve toward the chuck axis.

According to an advantageous embodiment of the inventive chuck, the push-sleeve has an at least partially radially extending stirrup axially formlockingly engaging in at least partially radially extending grooves of the respective locking members.

According to a further advantageous embodiment of the inventive chuck, the push-sleeve has an at least partially axially extending, receiving opening that at least partially circumferentially surrounds the locking members.

In the locking position of the chuck, the locking members are supported against the inner surface of the locking sleeve, extend into the interior of the coupling sleeve, and engage, optionally, in diametrically opposite, axially closed, locking grooves of a working tool which is received in the chuck.

Advantageously, the inventive chuck includes a damping member, which is engaged by the locking sleeve, for dissipating the idle impact energy applied to the locking members and which is transmitted to the damping member by the locking sleeve that supports the locking members.

When a working tool is introduced into the chuck, which is fixedly connected with the power tool, the locking members are displaced, against a spring-biasing force, along a radial conical surface of the locking sleeve toward the power tool and are pressed radially outwardly in an available radial free space by the chamfers of the locking grooves of the working tool. As soon as the locking members are deflected above the cylindrical outer surface of the working tool stem, the working tool can be inserted until it abuts an anvil of the power tool. A force, which is applied by a spring, biases the locking members along the radial conical surface of the locking sleeve inward into the locking grooves of the working tool stem. The working tool becomes locked without a manual displacement of any part of the chuck.

In the operational condition of the power tool, the reference surfaces of the locking members engage, under the action of the spring and the driving stirrup of the push-sleeve, in case the driving stirrup is provided, the end surfaces of the locking sleeve facing the power tool and are pressed radially by the conical surfaces into engagement with respective locking grooves of the working tool stem, providing for a limited axial displacement of the working tool. Simultaneously, the locking members transmit, via the side surfaces of the locking groove, a torque to the working tool.

In case of an idle impact, the end surfaces of the locking grooves of the working tool stem, which face the power tool, engage the end surfaces of the locking members, pressing the locking members against radial end surfaces of the locking sleeve facing the power tool, with the locking sleeve thereby being pressed against the damping member which cushions the idle impact.

Upon the manual displacement of the actuation sleeve toward the power tool, the locking members are displaced by the push-sleeve, which is adjoined axially by the actuation sleeve, out of the interior of the coupling sleeve and are displaced, by the working tool stem extending through the coupling sleeve, radially into their release position, when the working tool is withdrawn from the coupling sleeve. The locking members are held in the release position by the push-sleeve.

The novel features of the present invention, which are considered as characteristic for the invention, are set forth in the appended claims. The invention itself, however, both as to is construction and its mode of operation, together with additional advantages and objects thereof, will be best understood from the following detailed description of preferred embodiments, when read with reference to the accompanying drawings.

DETAILED DESCRIPTION OF THE PREFERRED EMBODIMENTS

Figure 1:
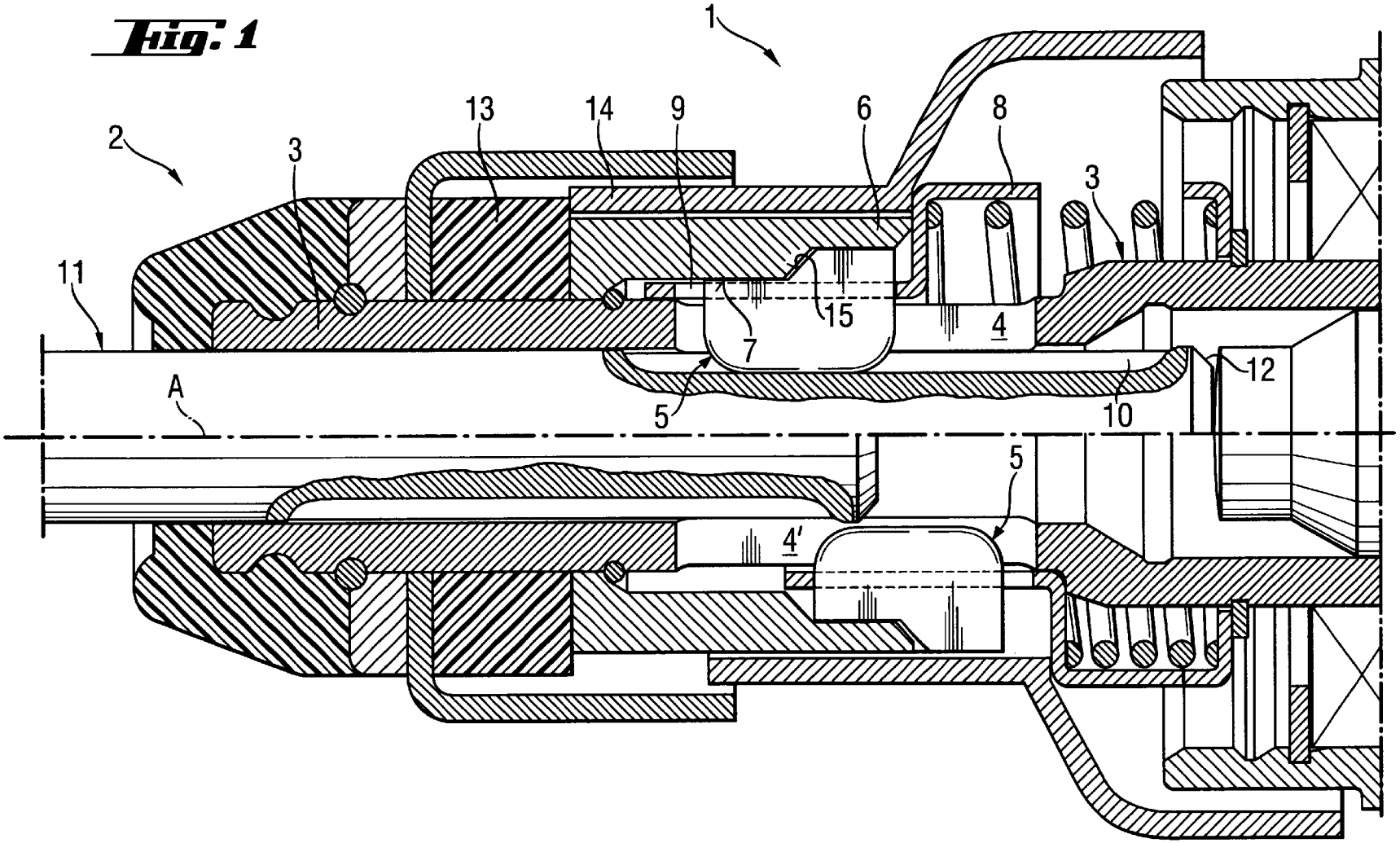
FIG. 1 a cross-sectional view of a first embodiment of a chuck for a percussion hand-held power tool according to the present invention.

A percussion hand-held power tool 1, which is shown only partionally in the drawings, includes a chuck 2 having a coupling sleeve 3, two diametrically opposite radial slot-shaped openings 4,4', and two axially and radially displaceable, locking members 5 displaceable in the two openings 4,4', respectively. The chuck 2 further includes a locking sleeve 6 that surrounds the coupling sleeve 3 and both locking members 5, and a spring-biased, axially displaceable push-sleeve 8 that formlockingly cooperates with the locking members 5. The locking sleeve 6 has an inner surface 7 that expands radially in a direction toward the power tool. The locking members 5, the radial dimension of which exceeds the width of the wall of the coupling sleeve 3 and which are supported against the inner surface 7 of the locking sleeve 6, extend into the interior of the coupling sleeve 3. As the width of the openings 4.4' of the coupling sleeve 3 narrows toward the axis A of the chuck 2, the radial displacement of the locking members 5, the width of which likewise narrows toward the axis A, is limited. The push-sleeve 8 has at least partially axially extending, receiving cavity 9 which at least partially surrounds the locking members 5. The two locking members 5, which are provided, at their respective opposite sides of their axially extending sides adjacent to the chuck axis A, with chamfers, extend into two, diametrically opposite, axially closed, locking grooves 10 which are formed in a working tool stem 11 which is received in the coupling sleeve 3. The stem 11 has, at its end surface facing in a direction opposite operational direction of the working tool, a chamfer 12. The locking sleeve 8, which supports, at least partially the locking numbers 5, abuts a damping member 13 formed of an elastomeric material. An actuation sleeve 14 adjoins the locking sleeve 8 at the working tool side of the locking sleeve 8. The locking members 5 have each, along its length, a reference surface 15 which faces in the operational direction of the working tool and extends substantially transverse to the working tool axis A.

Figure 2:
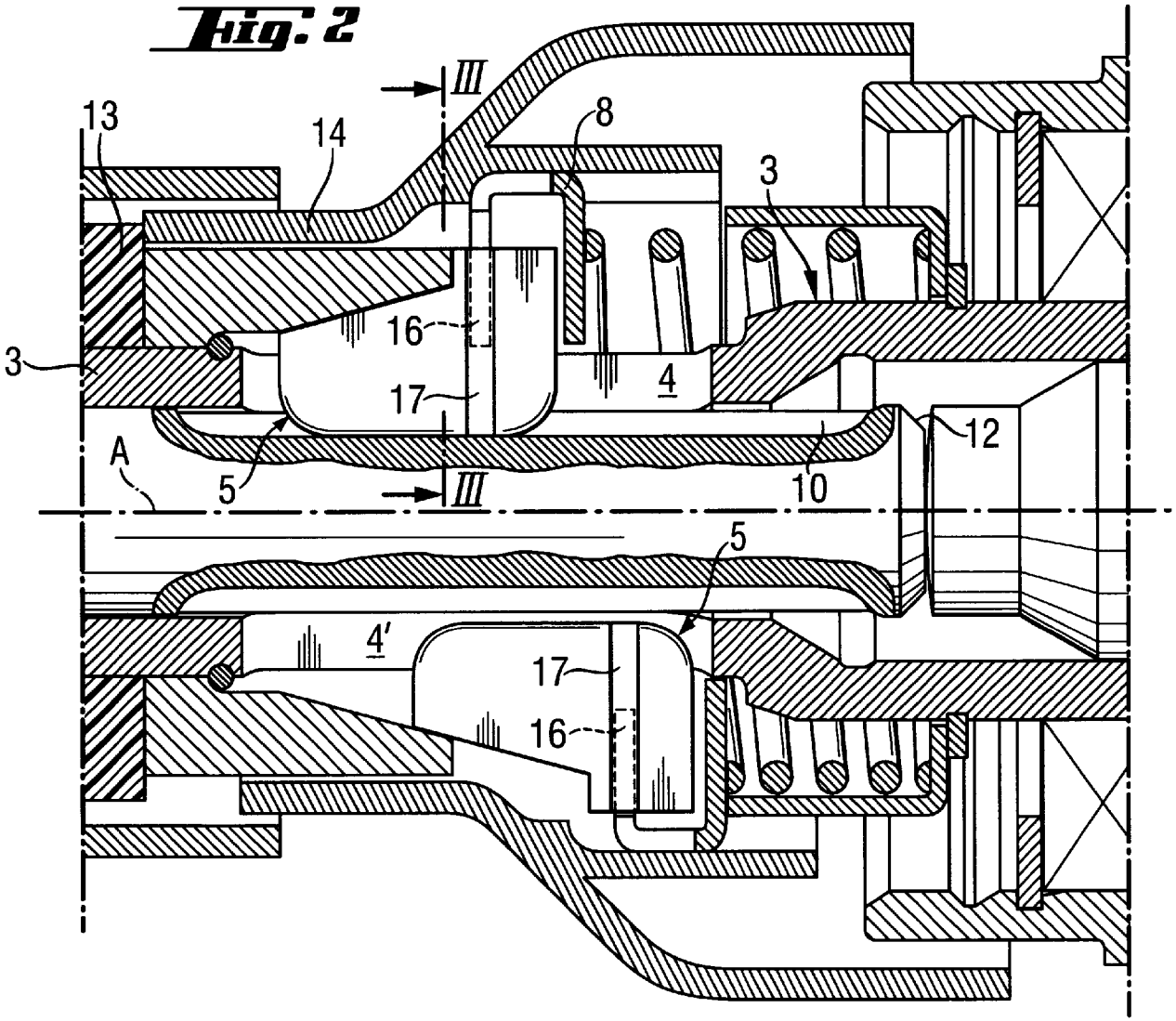
FIG. 2 a cross-sectional view of a second embodiment of a chuck for a percussion hand-held power tool according to the present invention.

The embodiment of the chuck shown in FIG. 2 differs from that of FIG. 1 in that the push-sleeve 8 forms an at least partially radially extending, receiving stirrup 16 which axially formlockingly engages in at least partially radially extending, receiving grooves 17 formed in the locking members 5.

Figure 3:
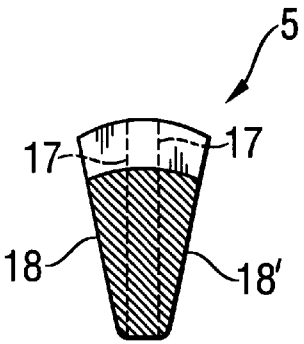
FIG. 3 a cross-sectional view of a locking member for the chuck.

As shown in FIG. 3, which shows a cross-section of a locking member 5 taken transverse to the axis A, the locking member 5 has two symmetrically opposite, non-parallel side surfaces 18, 18" tapering toward each other in a segment—like manner.

Though the present invention was shown and described with references to the preferred embodiments, such are merely illustrative of the present invention and are not to be construed as a limitation thereof, and various modifications of the present invention will be apparent to those skilled in the art. It is, therefore, not intended that the present invention be limited to the disclosed embodiments or details thereof, and the present invention includes all variations and/or alternative embodiments within the spirit and scope of the present invention as defined by the appended claims.

What is claimed is:

1. A chuck for a percussion hand-held power tool, comprising a coupling sleeve (3) for receiving a working tool and having two diametrically opposite, slot-shaped, radial openings (4, 4'); two locking members (5) radially and axially displaceable in respective radial openings (4, 4'); a locking sleeve (6) surrounding the coupling sleeve (3) and the locking members (5) and having an inner surface (7) radially expanding in a direction opposite to an operational direction of the working tool; and a spring-biased push-sleeve (8) formlockingly cooperating with the locking members (5), wherein the locking members (5) are supported against the inner surface (7) of the locking sleeve (6), extend into an interior of the coupling sleeve (3), and have each a radial dimension greater than a thickness of the coupling sleeve wall and a width decreasing toward a chuck axis (A) and wherein the push-sleeve (8) has an at least partially radially extending stirrup (16) axially formlockingly engaging in at least partially radially extending grooves (17) of respective locking members (5).

2. A chuck according to claim 1, wherein the radial openings (4, 4') of the coupling sleeve (3) have each a width decreasing toward the chuck axis (A).

3. A chuck according to claim 1, wherein the push-sleeve (8) has an at least partially axially extending, receiving opening (9) that at least partially circumferentially surrounds the locking members (5).

4. A chuck according to claim 1, wherein each locking member (5) has, along a length thereof, a reference surface (15) extending substantially transverse to the chuck axis and facing in an operational direction of the working tool.

5. A chuck according to claim 1, further comprising a damping member (13) formed of an elastomeric material which is adjoined by the locking sleeve (6).

* * * * *